US005295998A

United States Patent [19]

Merritello et al.

[11] Patent Number: 5,295,998

[45] Date of Patent: Mar. 22, 1994

[54] ADJUSTING PH IN DYEING PROCESSES USING $CO_2$

[75] Inventors: Ronald J. Merritello, Palos Heights, Ill.; William F. Kilgore, Kingwood, Tex.; David M. Forstrom, Duluth, Ga.; Terence A. Lane, Charlotte, N.C.

[73] Assignee: Liquid Carbonic Industries Corporation, Chicago, Ill.

[21] Appl. No.: 13,016

[22] Filed: Feb. 2, 1993

[51] Int. Cl.[5] ..... D06P 1/00

[52] U.S. Cl. ..... 8/474; 8/505

[58] Field of Search ..... 8/474, 505

[56] References Cited

U.S. PATENT DOCUMENTS

| | | | |
|---|---|---|---|
| 3,837,796 | 9/1974 | Fleissner et al. | 8/505 |
| 3,888,913 | 6/1975 | Baumann et al. | 8/531 |
| 3,990,840 | 11/1976 | von der Eltz et al. | 8/477 |
| 4,066,387 | 1/1978 | Lewin et al. | 8/619 |
| 4,089,644 | 5/1978 | Carbonell et al. | 8/400 |
| 4,089,645 | 5/1978 | Simpson et al. | 8/508 |
| 4,101,274 | 7/1978 | Beutler et al. | 8/539 |
| 4,536,907 | 8/1985 | Zumbrunn et al. | 8/149.1 |
| 4,732,572 | 3/1988 | Dilling | 8/557 |
| 5,009,667 | 4/1991 | Beck et al. | 8/115.56 |

*Primary Examiner*—Helene Klemanski

*Attorney, Agent, or Firm*—Lee, Mann, Smith, McWilliams, Sweeney & Ohlson

[57] ABSTRACT

A method to establish, maintain and control pH using carbon dioxide in aqueous dyeing processes applicable to dyeing a wide range of substrates with an aqueous dyeing solution incorporating either a water soluble or insoluble, natural or synthetic type of dye in batch or continuous processes, and at atmospheric pressure or under pressure.

13 Claims, 11 Drawing Sheets

ADJUSTING PH IN DYEING PROCESSES USING $CO_2$

FIELD OF THE INVENTION

The present invention is generally related to dyeing processes for a wide range of substrates including textiles and non textiles, and fibrous and non fibrous materials, and is specifically directed to dyeing processes utilizing $CO_2$ to establish, maintain and control the dye solution pH.

BACKGROUND OF THE INVENTION

Different dyes are used to impart color to an infinite variety of substrates in both batch and continuous type of processing. Dyes may be either synthetic or natural, water soluble or insoluble. Having a unique chemistry, one dye may be more suitable for a given type of substrate than another. The desired color or shading on a particular substrate will often dictate the dye selected.

For example, disperse dyes such as Disperse Yellow 3 (N-[4-[(2-hydroxy-5-methylphenyl)azo]phenyl]-acetamide) or Disperse Red 55 (1-amino-4-hydroxy-2-(2-hydroxyethoxy)-9,10 anthracenedione) are used extensively on polyester over a full shade range. However, when applied on acrylic fibers, disperse dyes are used primarily for pastel shades. Similarly, vat dyes such as Vat Black 25 (3-(1-anthraquinonylamino)anthra[2,1,9-m,n,a]naphth[2,3-h]acridine-5,10,15-(16H)-trione) are used almost exclusively for dull color shades on substrates including cotton and rayon. On the other hand, basic (cationic) dyes such as Basic Red 29 (thiazolium) or Basic Blue 41 (Benzothiazolium) have an almost unlimited range of shades with good color value. Basic dyes provide among the brightest colors such as mauve, fuchsia, violet and blue and are employed extensively on acrylics and often on paper, silk and leather. Likewise, azoic dyes such as the Naphthol compounds offer a wide range of shades but are typically used to produce full shades of red, scarlet and burgundy on substrates including cotton, polyester, linen, jute, hemp, and rayon.

Although many dyes can be used in both batch and continuous processing, dye selection may be contingent on the type of dyeing process required. For example, direct dyes such as Direct Black 80 (7-amino-2-{7-[p-(4-amino-6-1-naphthylazo)phenylazo]-8-hydroxy-6-sulfo-2-naphthylazo}-1-naphthol-3-sulfonic acid) used on a variety of substrates including cotton and rayon are processed continuously or in batch. The same is true for azoic dyes and sulfur dyes such as Sulfur Black 1 (constitution unknown). However, the acid dyes such as Acid Blue 40 (2-Anthracenesulfonic acid) or Acid Orange 156 (Benezenesulfonic acid) originally were devised exclusively for dyeing wool and will typically undergo batch processing in order to acquire uniformity of color.

Regardless of the physical and chemical nature of a dye or substrate employed, it is always important to have the correct solution pH. A good general description of the coloration and dyeing processes for many of the above listed substrates can be found in DYEING PRIMER, a series of short papers on the Fundamentals of Dyeing in *Textile Chemist and Colorist.* The following articles from *Textile Chemist and Colorist* are included: "What are Dyes? What is Dyeing?" by J. Richard Aspland, Vol. 12, No. 1, 1980; "Dyeing With Acid Dyes" by J. Lee Rush, Vol. 12, No. 2, 1980; "Dyeing With Basic Dyes" by Mathias J. Schuler, Vol. 12, No. 3, 1980; "Dyeing with Direct Dyes" by Marshall White, Jr., Vol. 12, No. 4, 1980; "Dyeing With Vat Dyes" by Claude S. Hughey, Vol. 12, No. 5, 1980; "Dyeing With Sulfur Dyes" by Leon Tigler, Vol. 12, No. 6, 1980; "Dyeing With Azoic Dyes" by Herbert B. Moore, Jr., Vol. 12, No. 7, 1980; "Dyeing With Disperse Dyes" by Mathias J. Schuler, Vol. 12, No. 8, 1980; "Dyeing With Reactive Dyes" by Peter J. Dolby, Vol. 12, No. 9, 1980; "Special Coloration Techniques" by J. Richard Aspland, Vol. 12, No. 10, 1980; "The Application of Color Technology in Today's Textile Industry" by Ralph Besnoy, Vol. 12, No. 11, 1980; "Kinetics and Equilibria in Dyeing" by Ralph McGregor, Vol. 12, No. 12, 1980.

A dyeing solution must maintain the proper pH to provide accurate and consistent shading of color. This applies to virtually any type of dye or substrate regardless of the mechanical processing employed. Control of pH in a dyeing process is critical and is a function of many factors including: the dye, the amount of dye used, the chemistry of the application medium (typically water), the rate of temperature change of the dyeing process, and the rate and method of dye exhaustion onto the substrate.

In order to preserve proper pH, chemical buffering systems are incorporated into dyeing solutions. A chemical buffering system is one that maintains the correct acidity or alkalinity of the dyeing solution and consists of a weak acid or weak base and its salt. The combination or concentrations of the weak acid/base and its salt determines the buffering range and capacity. Commonly used prior art systems for buffering a dyeing solution and controlling pH include ammonium sulfate, phosphoric acid and acetic acid. The availability of these chemicals and their ability to lower the dye bath pH has made them desirable.

Ammonium sulfate, for example, is a very common pH control for a variety of dyes and substrates. Azoic dyes, disperse dyes, vat dyes, acid dyes, and basic dyes have all utilized ammonium sulfate to control pH. A conventional prior art process using ammonium sulfate pH control consists of a solution made up of about 2% ammonium sulfate having water as the application medium. 1–2% leveling agent and 0.25% surfactant are then added. The substrate such as nylon or polyester is introduced into the bath at about 40° C. and runs without the dye for 5 minutes. Once the dye is added, the solution is heated by introducing stem for 25–35 minutes to complete the dyeing process. Here, the ammonium sulfate is used to control pH and maintain an acidic dye solution. Steam is employed at either atmospheric pressure or under pressure to each and maintain a near boiling temperature.

Another prior art process which uses phosphoric acid as the pH control employs a solution of about 0.50% phosphate buffer (which includes the phosphoric acid) and 0.50% surfactant. The dye is added to cold water in a batch process and then steamed until well mixed with water. All other chemicals such as antifoams and water softeners are added except the phosphate buffer. The batch is circulated for 3–5 minutes. Thereafter, the substrate is added and circulated for 2 minutes. The buffer is then added and the temperature is raised to 180° F. at a rate of 4° F. per minute using steam. Once the 18020 C. temperature is maintained for 5 minutes, a substrate sample is tested for accuracy and consistency of shading.

Many such prior art methods of maintaining proper pH in dyeing solutions are considered hazardous and toxic according to current environmental regulations. For example, acetic acid, ammonium sulfate and phosphoric acid all enhance microbial growth in receiving water systems such as lakes and rivers. These microorganisms require nutrients encompassing a variety of carbon compounds such as acetate from spent acetic acid, nitrogen from ammonium sulfates, and phosphates from phosphoric acid. The bacteria also consume large amounts of oxygen indicative of an increase in the Biological Oxygen Demand (BOD) of the water.

Consequently, the bi-products of the prior art methods if discharged into a water system will escalate the growth of bacterial. Hence, the oxygen level is depleted leaving little if any oxygen for aquatic growth such as fish. The result is a lifeless water stream and an imbalance in the ecosystem. Therefore, prior art methods of pH control require careful effluent treatment and disposal.

In addition, a bi-product of an ammonium sulfate buffer is an ionized form of ammonia that cannot be leached into an effluent water going into city waste treatment system. Further, the acetic acid method of pH control results in zinc removal from the latex backing of conventional textile materials such as "scatter" rugs. It is very difficult to dispose this material.

As a result, the dye industry has been seeking new methods to maintain and control pH that obviate the use of such chemicals as acetic acid, ammonium sulfate and the like. Moreover, environmental problems with effluent discharge have caused dyers to incorporate more exacting controls in the dyeing operations while looking for new methods to monitor pH. Many prior art methods only add the pH adjusting chemical(s) such as acetic acid, during the initial batch formulation and do not provide an ongoing capability to adjust the pH during the dyeing cycle. Without capability to continuously adjust the pH, rework is frequently necessary and consequently more dye is utilized. Therefore, better methods of repeatability which lessen the amount of rework have been sought.

OBJECTS OF THE PRESENT INVENTION

It is an object of the present invention to provide an improved method of establishing, maintaining and controlling proper pH in dyeing processes.

Another object of the present invention is to provide a method for establishing, maintaining and controlling the proper pH of a dyeing solution using $CO_2$.

Another object is of the present invention is to provide a method for establishing, maintaining and controlling the proper pH of a dyeing solution using $CO_2$ as a buffer for all types of dyes and substrates.

A further object of the present invention is to provide a method of dyeing substrates wherein $CO_2$ is used to establish, maintain or control the proper pH of a dyeing solution when operating under pressure or at atmospheric pressure.

A further object is of the present invention to provide a method of dyeing substrates wherein $CO_2$ is used to establish, maintain or control the proper pH of a dyeing solution in batch or in continuous processing.

A further object is to provide a method to maintain proper pH in dyeing solutions which obviates the use of acetic acid, ammonium sulfate and their equivalents.

BRIEF SUMMARY OF THE INVENTION

The present invention comprises a method for maintaining dye solution pH using carbon dioxide in a batch or a continuous process at atmospheric pressure or under pressure. Also, the subject invention may be used to initially lower dye solution pH only or act as buffer during the dyeing process.

Carbon dioxide is added to an aqueous dyeing solution to reduce or maintain the pH. Carbon dioxide is added to a dye solution on an as-needed basis either in volume or continuously. Carbon dioxide and water form carbonic acid which dissociates into bicarbonate, carbonate and hydrogen ions. Upon adding carbon dioxide to the dyeing solution, hydrogen ion concentration increases, thereby reducing the pH.

Because bicarbonate is a naturally occurring buffer in water, the dissociation of carbonic acid does not destroy the natural alkalinity (or buffering) of the aqueous dyeing solution while lowering the pH. As a result, dye solution stability is more reliable.

Unlike other prior art methods used to lower pH, carbon dioxide does not form unwanted conjugate salts as it lowers pH. Stated differently, as the dyeing solutions becomes "more acidic", additional carbon dioxide does not produce any of the unwanted bi-products such as acetates, ammonium or phosphates. Consequently, there are less environmental concerns and problems with the process effluent. The effluent requires less treatment and will not increase the Biological Oxygen Demand (BOD) of receiving water systems. Moreover, without unwanted conjugate salts forming, the chemical consistency of the dyeing solution is improved and there is less need to rework.

Because carbon dioxide is typically injected into a dyeing process, it is easy to distribute and mix uniformly throughout a dye bath. Penetration of the dye is improved and in many instances less dye is required. Exhaustion of both is more complete. Less dye goes to effluent discharge. Carbon dioxide will often provide deeper shading.

Furthermore, the carbonic acid (the result of the hydration of carbon dioxide) is a weaker acid than those utilized in prior art methods. Therefore, the addition of carbon dioxide causes smaller shifts in pH once the equilibrium has been reached. Over treatment of $CO_2$ or excess lowering of the pH is less likely. In addition, $CO_2$ can be or is often less expensive acid and it is stored in dry form as an inert gas.

DETAILED DESCRIPTION OF THE PREFERRED EMBODIMENT

In the subject invention, carbon dioxide is added to an aqueous dyeing solution to form carbonic acid. Carbonic acid dissociates forming bicarbonate (HCO3−) and a hydrogen ion ($H_+$). Subsequently, the bicarbonate dissociates into carbonate (CO3−) and a hydrogen ion (H+) until chemical equilibrium is reached. The chemical equilibrium equations in an aqueous dyeing solution upon $CO_2$ addition are as follows:

$$CO_2+H_2O=H_2CO_3$$

$$H_2CO_3 \rightleftharpoons H^+ + HCO_3$$

$$HCO_3 \rightleftharpoons H^+ + CO_3=$$

Because the secondary dissociation involves a weaker acid, bicarbonate is present in the dyeing solution in a greater amount than carbonate as pH drops. Nonetheless, both the carbonate and bicarbonate act as chemical buffers in solution (or compounds that dampen the movement of pH and help maintain a constant pH level) because the hydrogen ion concentration remains relatively stable.

The subject invention requires some water as the application medium or transport medium. The dyeing process can use carbon dioxide merely as a pH buffer and/or for ongoing control to maintain the pH of the dyeing solution. In either event, the pH may be initially lowered by adding carbon dioxide.

Substrates in the application of the present invention may include, yet are not limited to: nylon, cotton, rayon, polyester blends, acetate polyester, cellulose acetate, linen, wool, silk, acrylic and other fibers, jute, hemp, ramie, and other cellulosic fibers such as rayon, leather and other animal skins and furs, paper, plastics, yarns and strands of metal, glass and asbestos.

The dyeing of leather presents some difficulties not encountered in the dyeing of textiles. Unlike textiles, such as cotton, silk, wool, or some of the man-made fibers, leather is not a homogeneous product of definite composition whose chemical properties may be closely and accurately defined, but is rather a product derived from protein collagen (skin or hide substance) treated with one or more tanning agents. Also, leather retains many of the properties originally associated with the parent substance, and these affect profoundly and, in many ways, limit the dyeing properties of the final product. Chief among these properties are sensitivity to extremes of pH, thermolability, and the tendency to combine with acidic or basic compounds.

Further, various types of natural and synthetic dyes which include acid, basic, direct, vat, sulfur, azoic, invention is not intended to be limited to only the above mentioned dyes or substrates.

Figure 1:
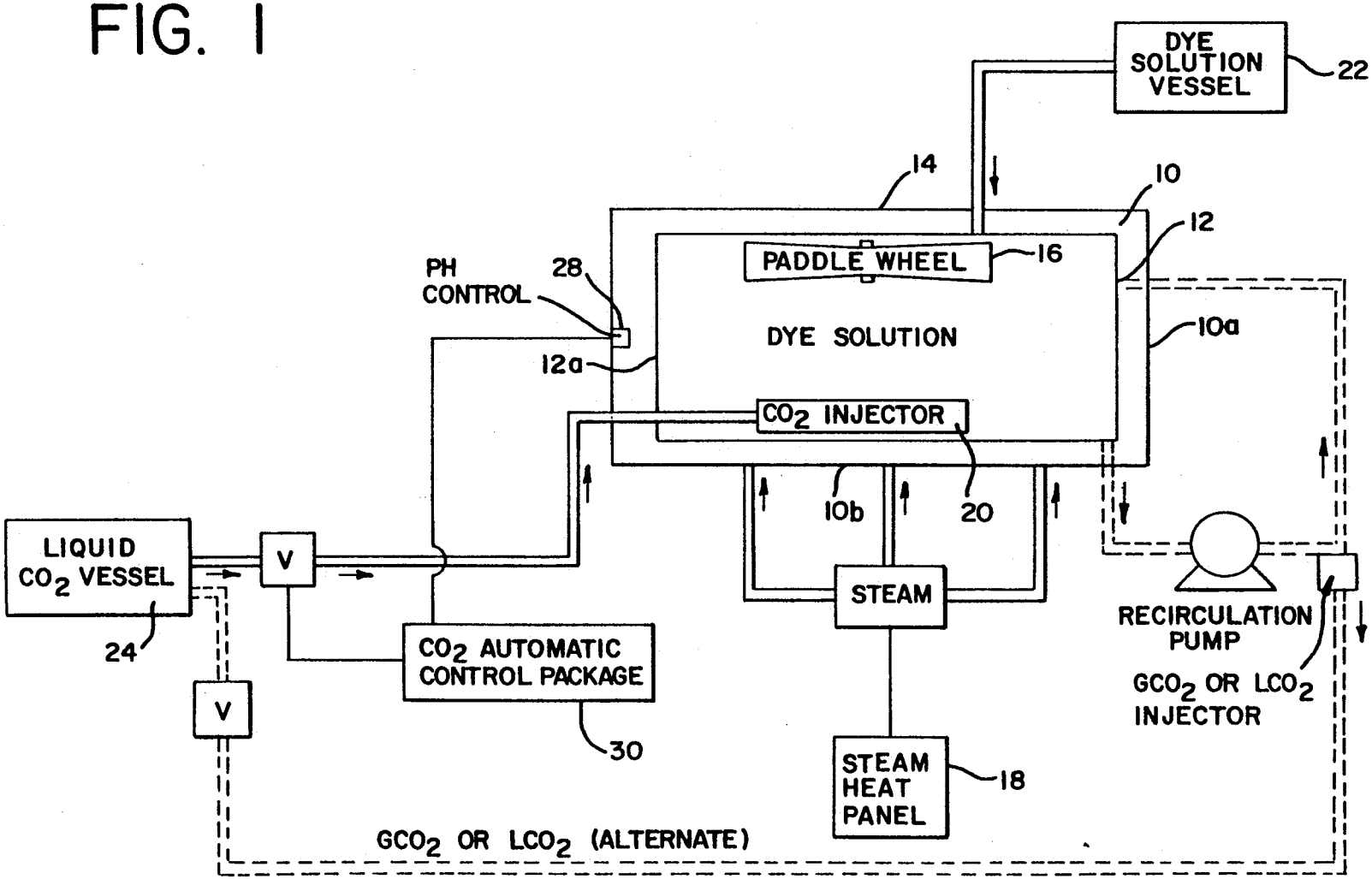
FIG. 1 is a schematic drawing of a typical batch dyeing process using $CO_2$ to maintain proper pH and operating at atmospheric pressure.

The subject invention can be used with either batch or continuous processing. Carbon dioxide may be used to control pH where there is movement of a substrate in dye solution, movement of dye solution through a stationary substrate, or movement of both substrate and dye solution. FIG. 1 and Examples 1, 2 and 3 demonstrate the subject invention in a batch dyeing process for two different substrates, nylon and polyester where both substrate and dyeing solution are agitated, or in motion.

Figure 6:
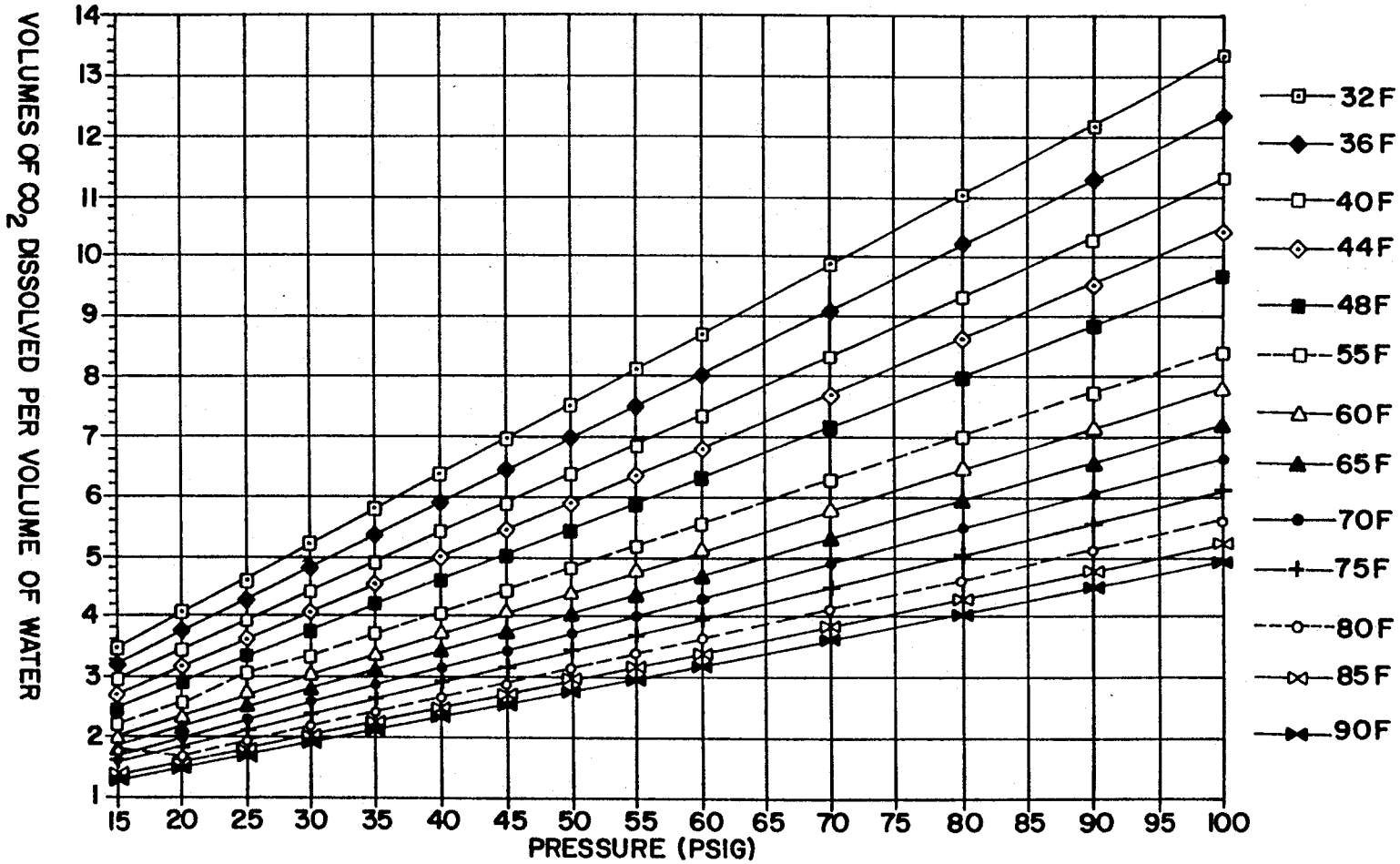
FIG. 6 charts the solubility of carbon dioxide in water at various pressures and temperatures.

As shown in the drawings and discussed in examples below, the subject invention can operate under atmospheric pressure or under pressure. A pressurized process is necessary for dyes that require an operating temperature in excess of the normal boiling point of water. Carbon dioxide or air can be used to pressurize the dyeing operation. FIG. 6 charts the increase in the solubility of carbon dioxide in water with increasing pressure. This chart evidences the likely reduction in the amount of carbon dioxide needed when dyeing substrates in carbon dioxide pressurized system.

Figure 2:
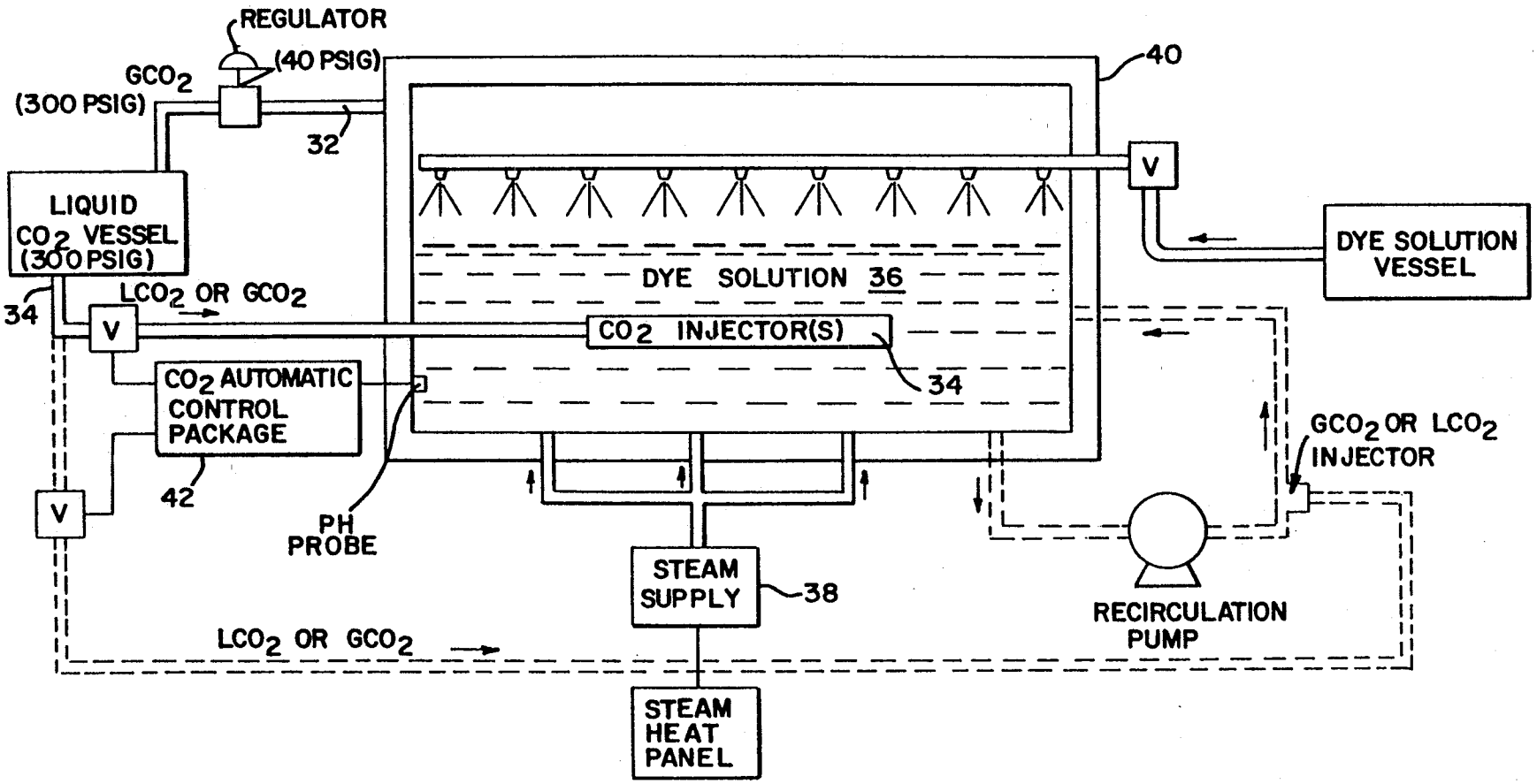
FIG. 2 is a schematic drawing of a typical batch dyeing process using $CO_2$ to maintain pH and operating under pressure greater than atmospheric pressure.
Figure 3:
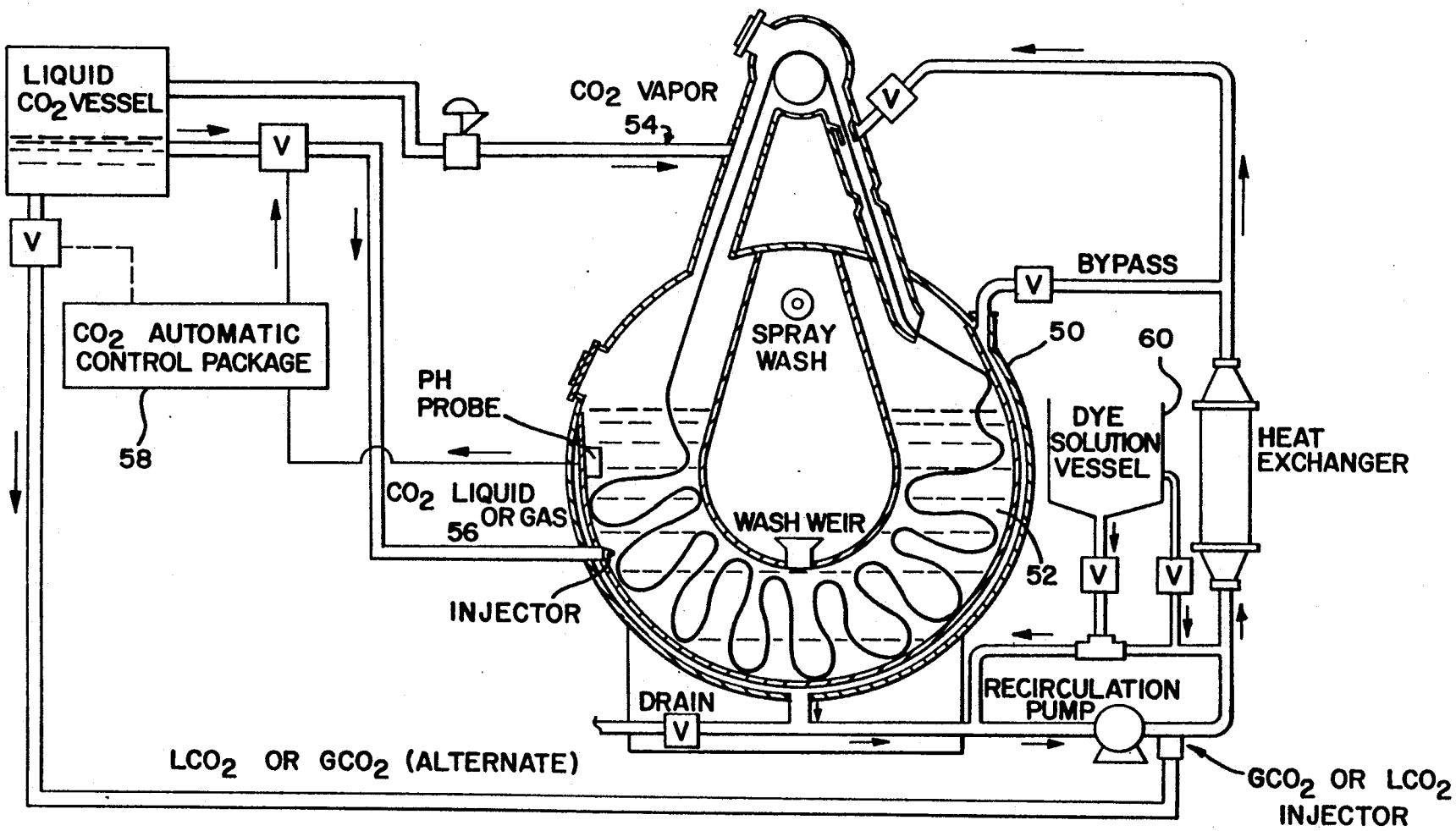
FIG. 3 is a schematic drawing of a typical continuous dyeing process using $CO_2$ to maintain pH and operating under pressure greater than atmospheric pressure.

FIG. 2 illustrates a typical batch dyeing process operating under pressure. Although air or carbon dioxide may be used to pressurize the dyeing vessel, FIG. 2 demonstrates a system using carbon dioxide to maintain an above atmospheric pressure within the processing vessel 40. Carbon dioxide is fed into the batch processing vessel 40 both in a vapor phase 32 to pressurize vessel and in a liquid or gaseous phase 34 to maintain pH. Here, the dye solution 36 is steam heated 38 and may be recirculated into the vessel 40. Automatic process monitoring and control 42 of the carbon dioxide is also optional. Similarly, FIG. 3 illustrates a typical pressurized continuous dyeing process 50. Strands of yarn were dyed in this type of process also operating above atmospheric pressure as discussed in Example 4.

The following are examples illustrative of the preferred embodiment above.

EXAMPLE 1

Batch Process under Atmospheric Pressure

Dyeing takes place in a V-shaped stainless steel dye vat 10 in batch as shown in FIG. 1. The vat 10 holds 400–600 pounds of textile material and 1000 gallons of dye solution. The vat has a form fitting, grated type basket 12 which holds the textiles away from the sides 10*a* and bottom 10*b* of the vat and is hinged (not shown) on one side at 12*a* to facilitate removal of the textiles after dyeing. There is a stainless steel top 14 and a paddle wheel agitator 16 for circulating the textiles, water and chemicals. The vat has a steam heating panel 18 which has automatic control for injecting steam. A coarsely drilled pipe 20 distributes $CO_2$ gas and is located in the bottom of the vat. An externally mounted mixing vessel 22 of about 15 gallon capacity equipped with a mixer (not shown) is designed to blend dye chemicals before introduction to the vat through the vat cover 14. Water is pumped into and drained from the dye vat through separate fillings (not shown) in the vat bottom.

Carbon dioxide in bulk is stored in the usual manner in a vessel 24 as a refrigerated liquid (0° F.) under pressure (300 psig). It is passed through vaporizer, regulator, metering and shutoff valves 26 and is introduced to the vat through the drilled pipe 20 in the bottom of the disperse and reactive dyes, may use the method of the present invention. Other substrates and dyes may also use the method of maintaining pH herein. The present vat. $CO_2$ could be injected through a fine, sintered metal sparger (not shown). An automatic single loop feedback pH controller 28 system 30 is used to actuate a valve (not shown) which will introduce $CO_2$ at a rate which will attain the desired pH (5.5–6.0 for polyester [lower limit for dark colors, higher limit for light colors], 6.0–6.5 for nylon textiles). The automatic temperature controller 18 maintains the required temperature (185° F. for nylon, 210° F. for polyester) for dyeing.

The textiles dyed in this example are bath mats (also known as "scatter rugs" or "throw rugs") and toilet surrounds. These textiles are made from nylon (such as DuPont Antron or Monsanto's Ultron) or polyester fibers (such as DuPont Dacron). Blends of both nylon and polyester are also used. The fibers are sewn on a continuous basis by a roller/conveyor system to a nylon mesh, in helix fashion (½" length for nylon, ¾" length for polyester) and are left straight or sewn in "looped" fashion depending on the desired design. The sewn mesh is passed over a mixture of unvulcanized latex rubber, which upon curing forms a uniform and non-skid backing for the textile approximately 1/16" thick. The carpet is exposed to a stream of ammonia gas which functions as an alkaline scour pretreatment. The textile material is then cut into the desired shapes and is ready for dyeing.

EXAMPLE 2

Batch Dyeing of Nylon Rugs at Atmospheric Pressure

Dyeing using carbon dioxide was conducted at atmospheric pressure in batch process having a $CO_2$ diffuser or sparger and a $CO_2$ flow control system. Several acid dye solutions were slowly lowered from an initial pH value of about 8.0 to a final end point pH of about 6.0–6.5. This pH strategy allowed the dye to be evenly applied to the rug fibers without any splotchy areas and or proper shading.

Each batch used approximately 1,000 gallons of water with rug additions from between 300 pounds upward to 500 pounds. Each dye solution contained approximately 0.01 weight % of an acid dye Blue 86 (unspecified structure and molecular formula) per unit weight of substrate dyed, 0.25 weight % of 2.0% active silicone antifoam CK2 per unit weight of substrate dyes, and 0.5 weight % of surfactant penetrant SDP-2 (an aqueous mixture of sodium dodecylbenzene sulfonate and 2-propanol) per unit weight of substrate dyed. $CO_2$ fed at a rate of ten (10) pounds per hour worked well to give the pH response desired. An approximately total of four (4) to five (5) pounds of $CO_2$ was typically spent. Control was relatively simple as it was only necessary to set up the rotameter to feed $CO_2$ at the ten pounds per hour rate.

Figure 7:
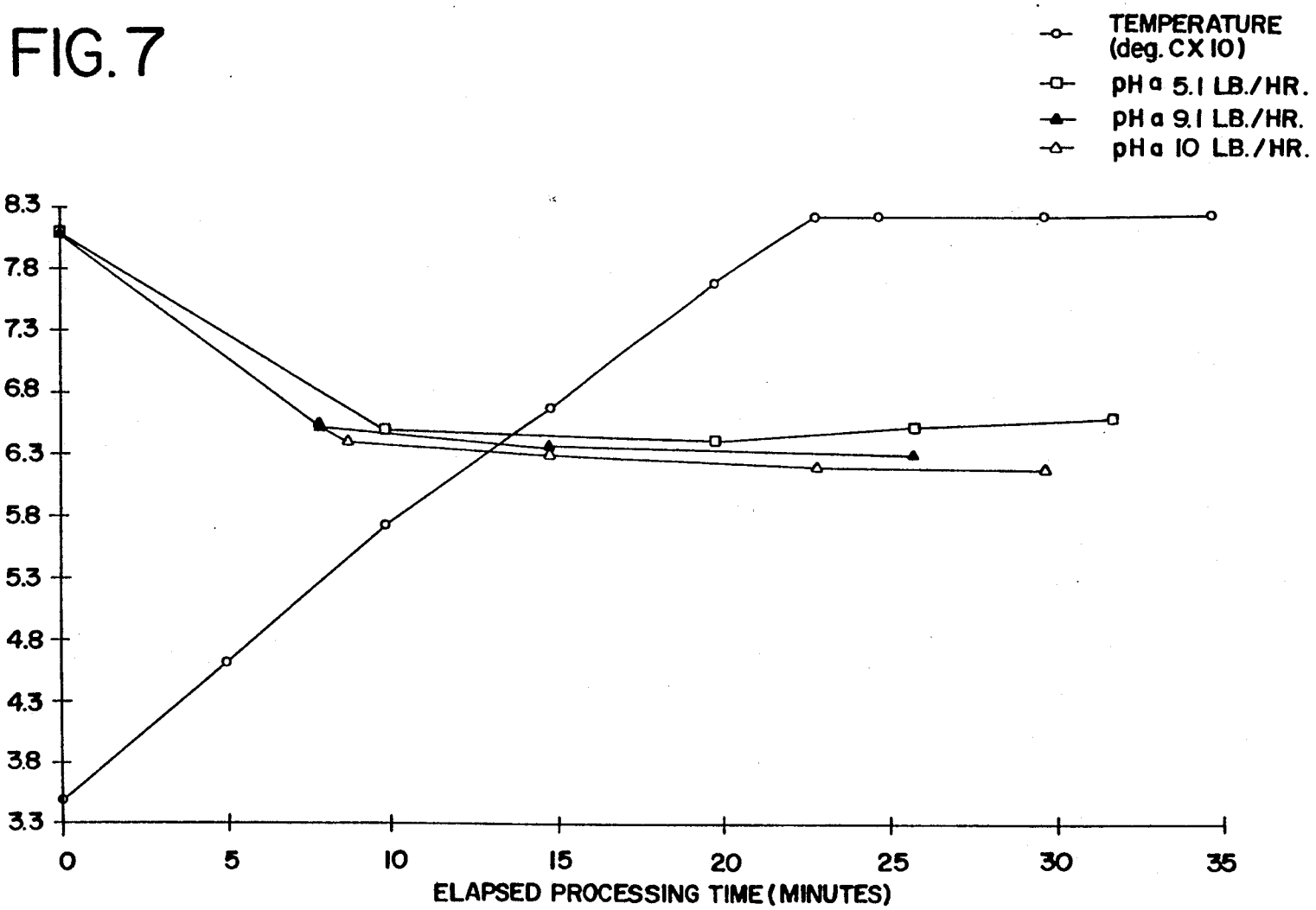
FIG. 7 is a graph representing test results from Example 2, showing typical temperature and pH profiles at various carbon dioxide flow rates.
Figure 8:
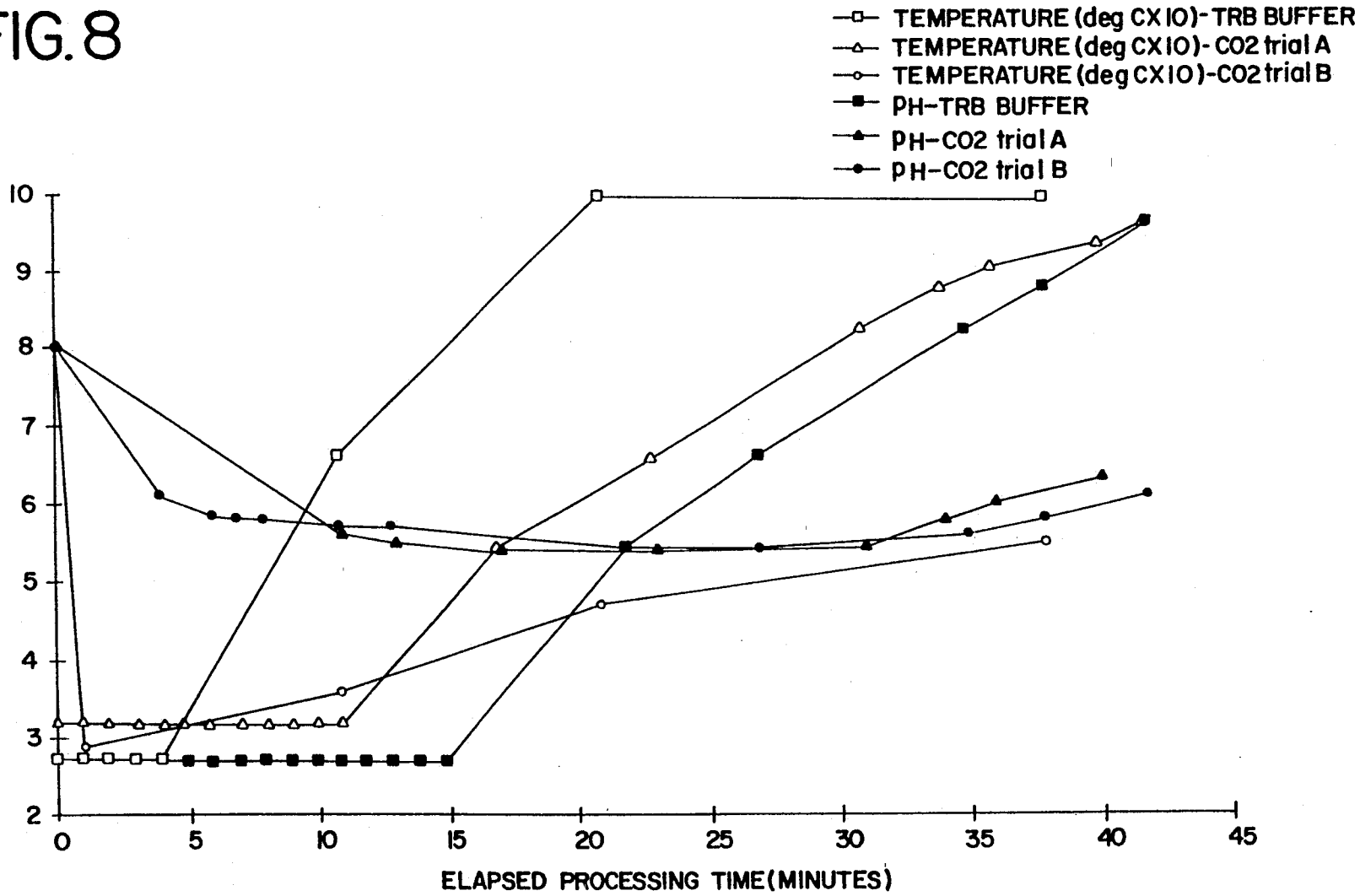
FIG. 8 is a graph representing test results from Example 3, showing typical temperature and pH profiles using TRB buffer or carbon dioxide at flow rates of A=28 pounds per hour or B=24.5 pounds per hour.
Figure 9A:
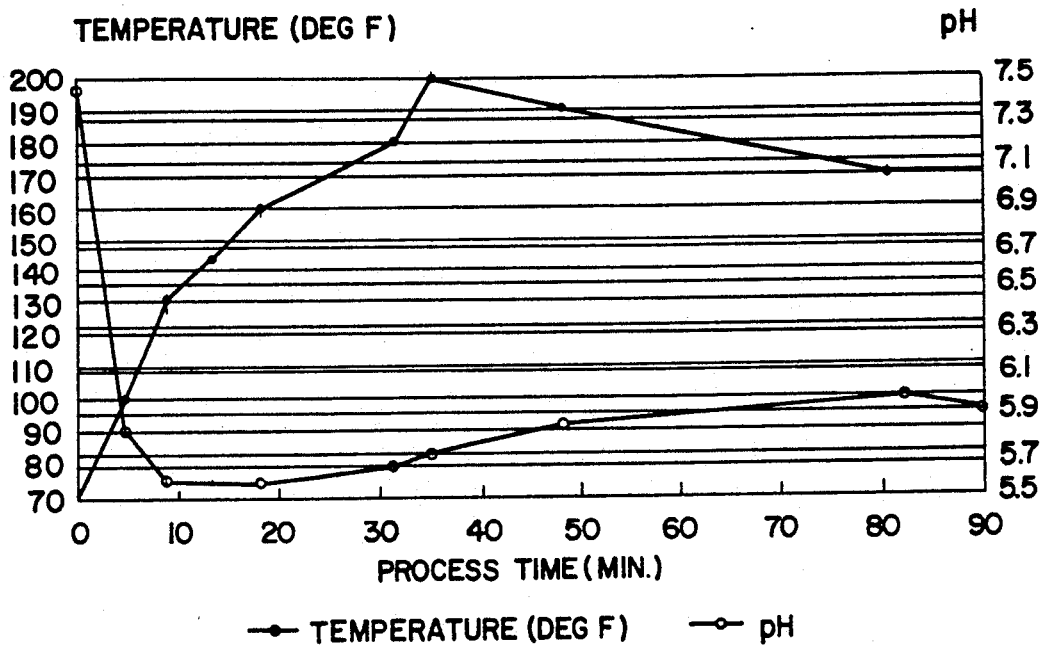
FIGS. 9A and 9B are graphs representing test results from Example 6 Test No. 1.
Figure 9B:
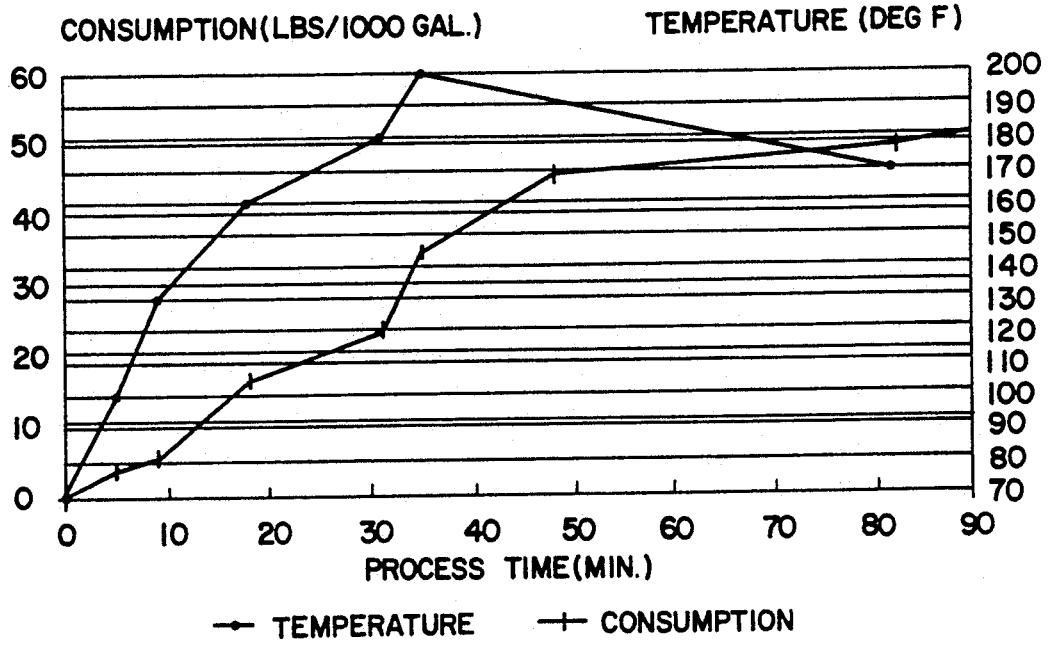
Figure 10A:
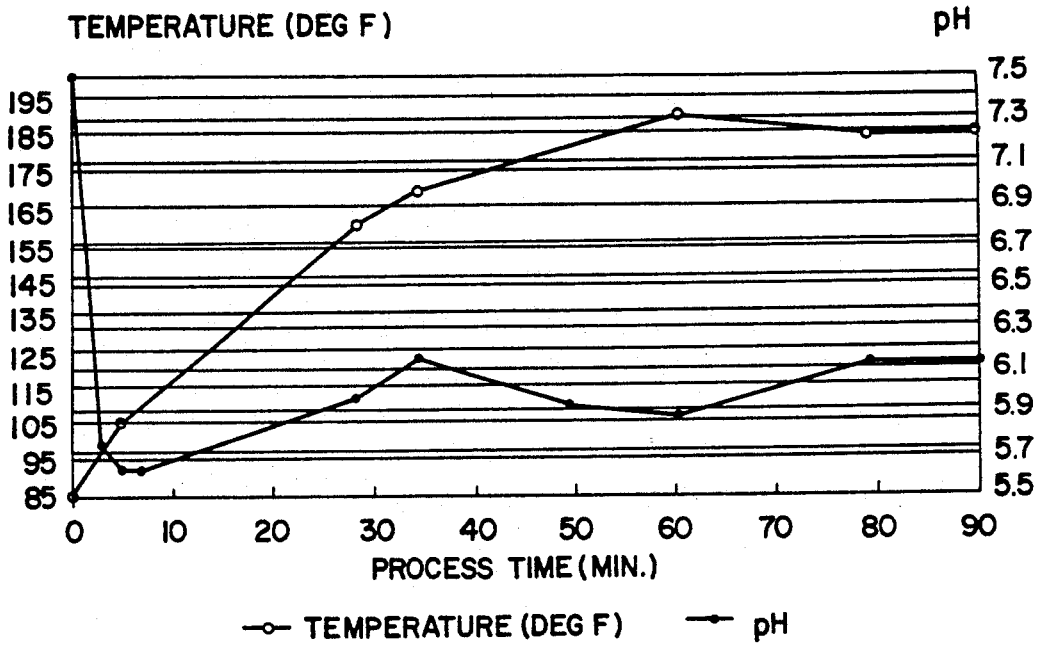
FIGS. 10A and 10B are graphs representing test results from Example 6, test 2.
Figure 10B:
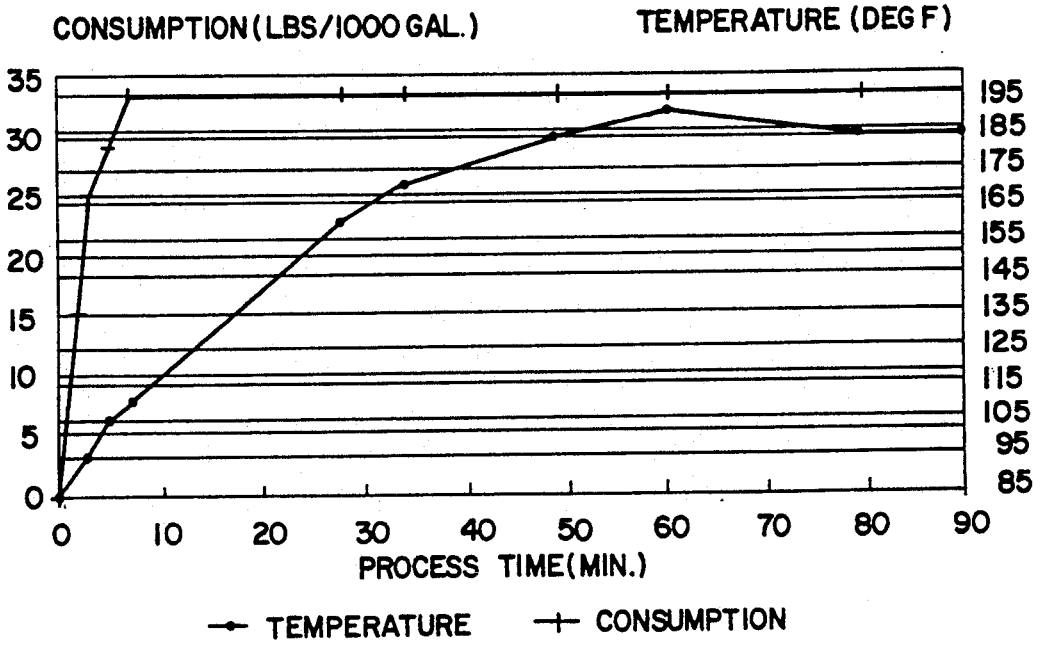
Figure 11A:
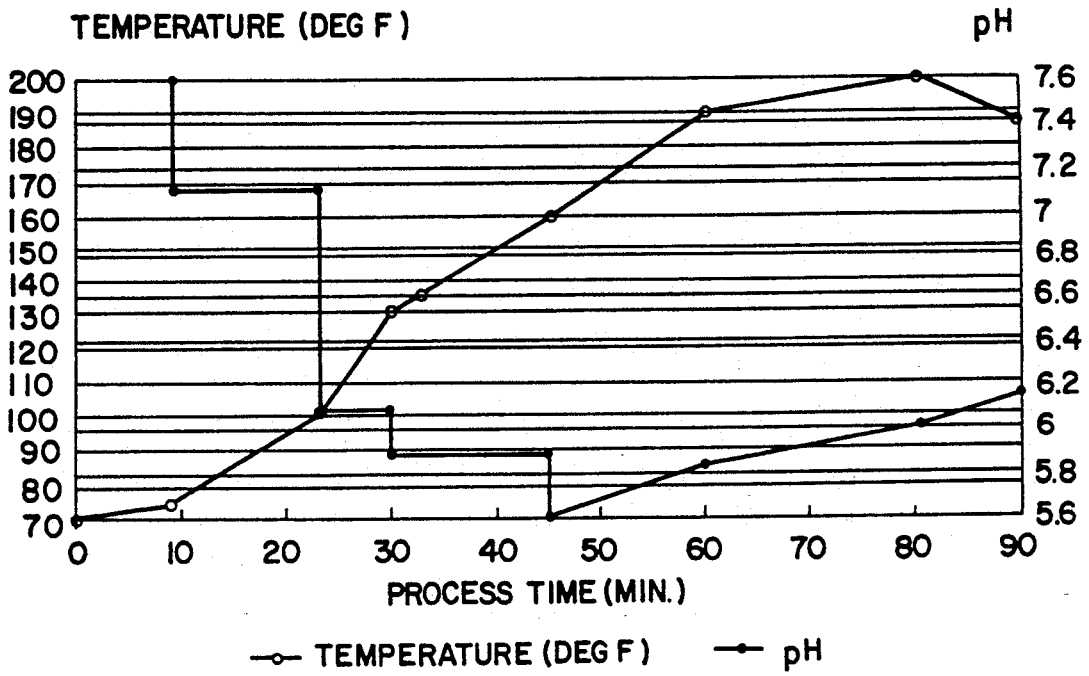
FIGS. 11A and 11B are graphs representing test results from Example 6, test 3.—.
Figure 11B:
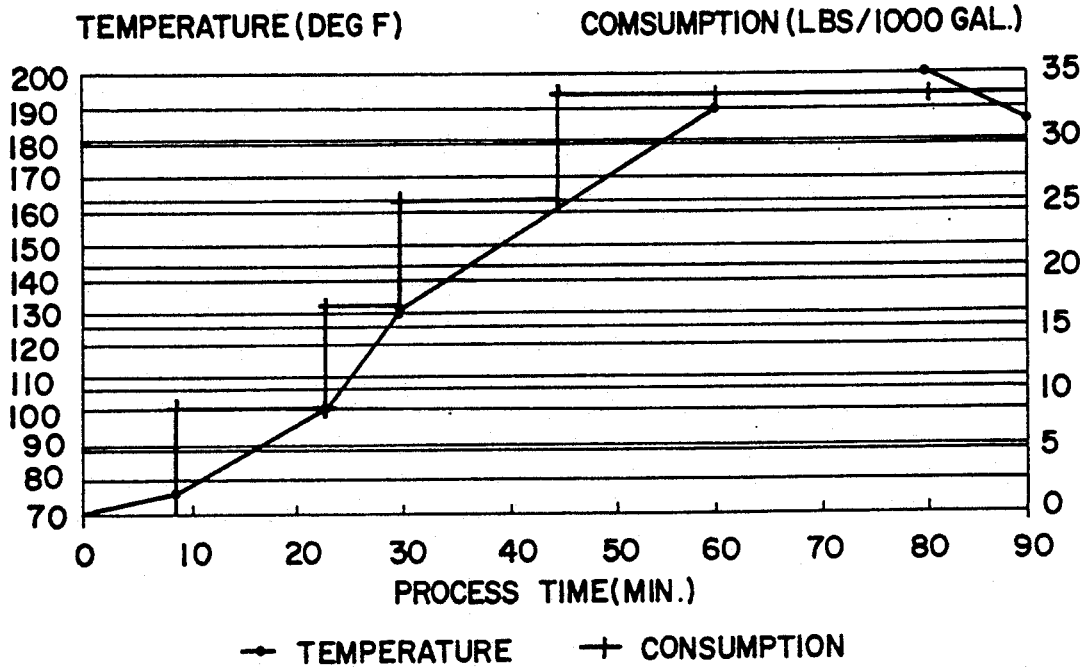

The system temperature was increased from an ambient temperature to a final batch temperature of about 85° C. and was held at 85° C. for five minutes. Using $CO_2$ as an acidifier, very reasonable pH response was obtained and the desired end point pH of 6.0–6.5 was maintained when the dyeing cycle ended at about 85° C. Start to finish dyeing took between 25–30 minutes after all the rugs and water were in the bath. The profiles of this test are shown in FIG. 7.

The results from using $CO_2$ for dyeing nylon rugs were outstanding. Desired dye uniformity was obtained even on the most difficult dark shades and no rework dyeing was necessary. Additionally, the dye bath was more completely exhausted.

EXAMPLE 3

Batch Dyeing Polyester Rugs at Atmospheric Pressure

Polyester rug dyeing takes place under harsher conditions as compared to nylon rug dyeing. First a slightly lower dye solution pH of about 5.2–5.6 is required. Secondly, the required operating temperatures for dyeing approaches boiling, 100° C., under normal atmospheric conditions. Thirdly, the dyeing time is longer, 35 minutes up to 45 minutes. Also, calcium carbonate filler is often leached from rug backings because of the lower pH, higher temperatures and longer dyeing times.

To achieve the required pH, carbon dioxide was introduced at about 25–28 pounds per hour into several different dye solutions. The dye solution consisted of either Disperse Yellow 42 (sulfanilide, 3-Nitro-N4-phenyl;$C_{18}H_{15}N_3O_4S$) or Basic Blue 41 in a 0.1% aqueous mixture with a surfactant, Antifoam CK2 0.25% concentration and 1-butanol 0.5% concentration (acting as an anti-precipitant) and Chromeassist 148 0.5% concentration (an anionic retardant for polyester blends). The pH maintained relatively constant without the need for additional carbon dioxide (although elevations in pH were observed toward the end of the cycle). The pH was satisfactory until 190° F. temperature was reached where some foaming/effervescing occurred toward the end of the dyeing cycle.

When atmospheric pressure is found not to be optimal for long term polyester rug dyeing, higher pressure of 34–40 p.s.i.g. should be used. The higher pressure may be provided by the $CO_2$ (as opposed to air) which will offer even more dye solution stability.

EXAMPLE 4

Dyeing Polyester Yarn in a Continuous Pressurized Process

Dyeing polyester yarn was conducted in a pilot scale pressured dyeing system having process equipment similar to that shown in FIG. 3. As illustrated in FIG. 3, a dye solution Ciba Geigy Terasil Blue BGE (dispersed) is often mixed in a separate vessel 60 and fed into a pressurized tank 50 where strands of yarn continuously passed through the dye solution 52. $CO_2$ vapor 54 is used to pressurize the system. Here, liquid $CO_2$ or gaseous $CO_2$ 56 is fed both directly into a dye solution bath retained at the bottom of the tank 50 to pressurize the vessel 50. For process control features, this type of system employs automatic process controls 58 of the carbon dioxide and dyeing solution.

A dispersed dye was applied to polyester yarn in a dye solution having a water to dye ratio of 10.6 liters water to 0.3 liters dye solution. The dyeing system operated under pressure between 34–40 psig. The test results are plotted on FIG. 4.

Figure 4:
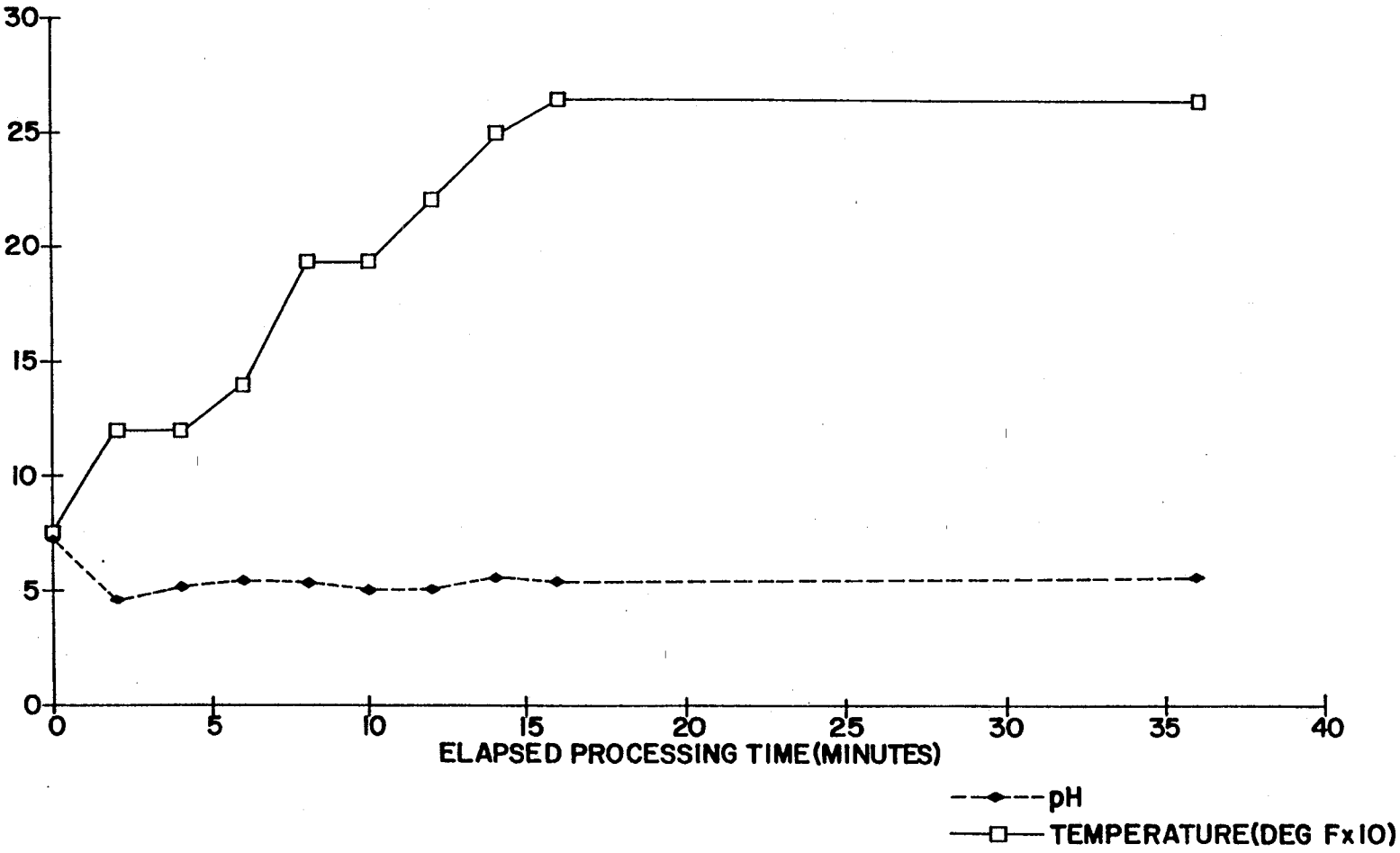
FIG. 4 is a graph representing test results from a continuous process wherein a disperse dye is applied on polyester yarn in a dyeing process pressurized with carbon dioxide. Temperature and pH are plotted on the Y axis and time is plotted on the X axis.

FIG. 4 demonstrates the initial drop in the water pH from 7.36 to 4.65 upon injecting carbon dioxide in the first few minutes of operation. Immediately following, a disperse dye was added to the water. As the dye solution temperature rose from about 105° F. to 265° F. the pH was adjusted manually and was maintained between 5.0–5.7. The recommended dye solution pH range for this particular solution was 4.5–6.0

This process yielded an acceptable dyed end product confirming that carbon dioxide controls the pH in such a pressurized dyeing system.

EXAMPLE 5

Dyeing Nylon Hosiery in an Open Batch Process

Figure 5:
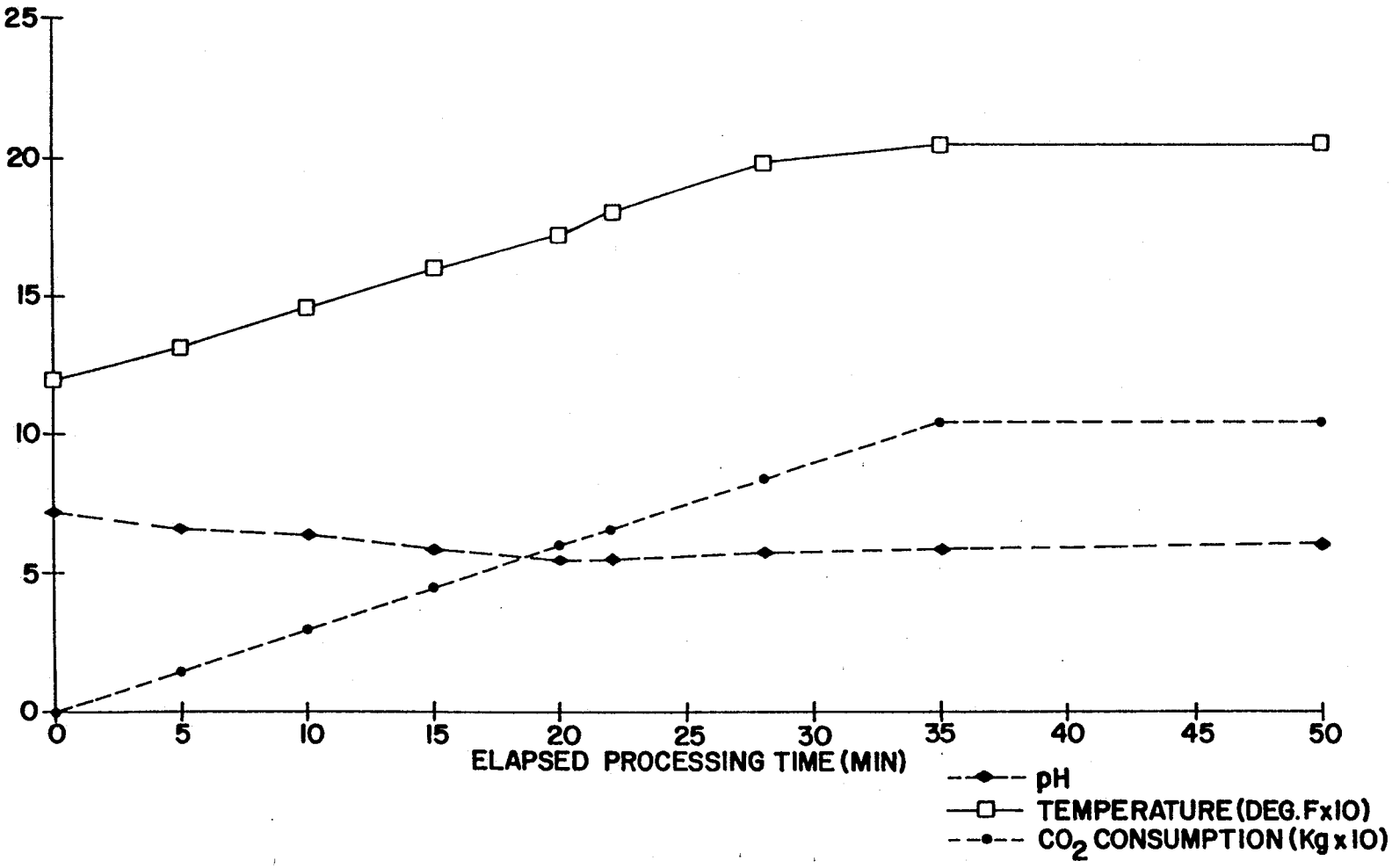
FIG. 5 is a graph representing test results from a batch process where an acid dye is applied on nylon hosiery at atmospheric pressure. Temperature, pH and carbon dioxide consumption are plotted on the Y axis and time is plotted on the X axis.

An acid dye, Ciba Geigy testilon acid dye (tan) was used with a nylon substrate at atmospheric pressure under full scale operating procedures. FIG. 5 shows the results. Here, carbon dioxide was added on a continuous basis to an open dye machine. For the first 35 minutes of this batch dyeing process, a total of 105 pounds of carbon dioxide was injected into the dye solution. Afterwards, the dye solution pH remained between 5.9 and 6.1 for an additional 20 minutes at temperature of 205° F. without further addition of carbon dioxide. 400 pounds of nylon product was dyed with acceptable leveling and an improved dye exhaustion rate.

Initially, 400 pounds of nylon product was added to 250 gallons of water (plus 1% leveling agent) at pH of 7.2 and a temperature of about 120° F. During the first 20 minutes of operation, the dye solution pH was reduced to 5.5 at a temperature of about 172° F. (The acid dye was added after 10 minutes of operation.) Carbon dioxide was injected to the dye solution for an additional 15 minutes until the dye solution temperature reached 205° F. Thereafter, without further addition of carbon dioxide, the pH remained nearly contant at 5.9 to 6.1 over the next fifteen minutes. This showed the pH stability of a dye solution that utilizes carbon dioxide to maintain pH while operating near an upper temperature limit of 212° F. under atmospheric pressure.

EXAMPLE 6

Dyeing Nylon Yarn in an Open Batch Process

Three tests were performed to demonstrate the use of $CO_2$ in adjusting the pH of dyebaths. Identical amounts of dye solution, process water and yarn were used in each test. $CO_2$ injection rates/amounts were varied over process time and are illustrated in the accompanying graphs, FIGS. 9A, 9B, 10A, 10B, 11A and 11B. Excellent results were achieved in all three tests demonstrating the wide variability of the use of $CO_2$ in the dyeing process.

blends, disperse byes will dye the different fibers to various depths (intensities). Disperse dyes are also used on polyester/nylon blends as they have marginal fastness on nylon.

Basic dyes have been used for dyeing silk and cellulose acetate. Leather and paper are also dyed with basic dyes.

Discussion of Theory of pH Control

Achieving the proper shading when dyeing textiles requires a tight control over the target pH range. Usually chemical buffering systems are incorporated to achieve this goal. A chemical buffering system consists of a weak acid or weak base and its salt. The combinations of concentrations of the weak acid/base and its salt will determine its buffering range and capacity. The process of this invention substitutes a carbonic acid buffering system for phosphate, ammonium sulfate or acetic acid systems. The system is chemically comprised of carbonic acid (formed from the hydration of dissolved carbon dioxide) and carbonate and bicarbonate salts which originate in process water or are leached from the latex backed textiles (which contain calcium carbonate as filler), the latter being the largest contributor in all probability. The rate of salt addition is governed by dye bath temperature and time. The concentration of carbonic acid is controlled by the injection rate of carbon dioxide and the pressure and temperature of the solution.

Tests so far have indicated that the use of carbon dioxide has increased the textile fiber's ability to accept dyes. This observation was made during a dyeing test with carbon dioxide when dark shades (the most difficult to dye) were used. A much deeper shading was observed, indicting the dye was more readily absorbed into the textile fibers than when using phosphate, acetic acid or ammonium sulfate buffering systems. A similar phenomenon has been observed in the leather manufacturing industry during the tanning process when carbon dioxide is used to adjust the pH of animal hides prior to the addition of the chrome compounds. Hides which are "defined" with carbon dioxide have the ability to General Description of Some Dye Chemicals and Types as Examples as Used for Dyeing

| | Name | Molecular Formula | Chemical Name |
|---|---|---|---|
| Acid | Orange 156 | $C_{21}H_{20}N_4O_5S.N_a$ | Benzenesulfonic acid |
| | 4-[[5-methoxy-4-[(4-methoxyphenyl)axo]-2-methylphenyl]azo]-,sodiumsalt | | |
| Acid | Blue 40 | $C_{22}H_{17}N_3O_6S.N_a$ | 2-Anthracenesulfonic acid |
| | 4-[[-(acetylamino)phenyl]amino]-1-amino-9,10-dihydro-9,10-dioxo-,monosodiumsalt | | |
| Basic | Red 29 | $C_{19}H_{17}N_4S.C_1$ | Thiazolium |
| | 3-methyl-2-[(1-methyl-2-phenyl-1H-indol-3-yl)azo]-,chloride | | |
| Basic | Blue 41 | $C_{19}H_{23}N_4O_2S.CH_3O_4S$ | Benzothiazolium |
| | 2-[[4-[ethyl(2-hydroxyethyl)amino]phenyl]azo]-6-methaxy-3-methyl,methylsulfate(salt) | | |
| Disperse | Yellow 3 | $C_{15}H_{15}N_3O_2$ | Acetamide |
| | N-[4-[(2-hydroxy-5-methylphenyl)azo]phenyl]- | | |
| Disperse | Red 55 | $C_{16}H_{13}NO_5$ | 9,10-Anthracenedione |
| | 1-amino-4-hydroxy-2-(2-hydroxyethoxy)- | | |
| Disperse | Blue 56 | $C_{14}H_9BrN_2O_4$ | 9,10-Anthracenedione |
| | 1,5-diaminobromo-4,8-dihydroxy- | | |

In general, acid (anionic) dyes are used on nylon (also known as polyamide) because of their attraction for the amide ($—NH_2$) group. Polyester, except when pretreated, has no affinity for ionic dye stuffs and requires disperse dyes. The action in this case is that the water insoluble dye is dispersed, forming a solid solution in the polyester fiber (which acts as the solvent).

In the case of nylon fiber blends, select acid dyes are used to achieve the desired color effects. In polyester absorb more chrome than those "delimed" with ammonium salts.

Using carbon dioxide to control the pH of dye baths is beneficial and superior to phosphoric acid-phosphate salt, ammonium sulfate or acetic or sulfuric acid system because of the following reasons:

1. Carbonic acid, the result of the hydration of $CO_2$, is distributed evenly throughout the dye bath and is added on an as-needed basis in order to control pH.

2. Carbonic acid, is a weaker acid than phosphoric, sulfuric or acetic and therefore will cause smaller shifts in pH in the neutral (pH 5–9) range. Overtreatment is less likely.

3. Using carbon dioxide improves the absorptivity of the dyes into the textile fibers. Less dye is discharged into effluent streams.

4. Carbon dioxide does not increase BOD (biological oxygen demand) like ammonium sulfate does (by raising the nitrogen level of the discharge waters), or like phosphoric acid (by adding phosphorous) or acetic acid (by adding carbon).

Various features of the invention have been particularly shown and described in connection with the illustrated embodiment of the invention, however, it must be understood that these particular arrangements merely illustrate and that the invention is to be given its fullest interpretation within the terms of the appended claims.

What is claimed:

1. A method for dyeing a substrate comprising the steps of:

providing a dye solution suitable for dyeing a substrate wherein said dye solution uses at least some water as a transport medium;

controlling the pH of said dye solution by introducing $CO_2$ into said solution; and applying said dye solution to said substrate.

2. The method of claim 1 wherein $CO_2$ is added to said solution until the desired pH is attained.

3. The method of claim 1 wherein $CO_2$ is periodically added to said solution to maintain said pH.

4. The method of claim 3 wherein the pH is continuously controlled during the dyeing process by the automatic injection of $CO_2$.

5. The method of claim 1 wherein said dye solution is applied in a batch processing device.

6. The method of claim 1 wherein said dye solution is applied in a continuous processing device.

7. The method of claim 1 wherein said aqueous dye solution includes a dye chosen from a group consisting of acid dyes, basic dyes, direct dyes, vat dyes, sulfur dyes, azoic dyes, disperse dyes and reactive dyes.

8. The method of claim 1 wherein said dye solution is heated during said dyeing process.

9. The method of claim 8 wherein said dye solution is heated by steam.

10. The method of claim 1 wherein said dye solution is applied in a pressurized atmosphere.

11. The method of claim 10 wherein air is introduced to create said pressure.

12. A method of claim 10 wherein carbon dioxide is used to create said pressure.

13. The method of claim 1 wherein said dye solution and said substrate are agitated.

* * * * *